US011688374B2

(12) United States Patent
Macias

(10) Patent No.: US 11,688,374 B2
(45) Date of Patent: Jun. 27, 2023

(54) MOTION/POSITION-SENSING RESPONSIVE LIGHT-UP MUSICAL INSTRUMENT

(71) Applicant: Nicholas J. Macias, Vancouver, WA (US)

(72) Inventor: Nicholas J. Macias, Vancouver, WA (US)

( * ) Notice: Subject to any disclaimer, the term of this patent is extended or adjusted under 35 U.S.C. 154(b) by 314 days.

(21) Appl. No.: 17/106,147

(22) Filed: Nov. 29, 2020

(65) Prior Publication Data

US 2021/0174772 A1 Jun. 10, 2021

Related U.S. Application Data

(60) Provisional application No. 62/974,487, filed on Dec. 4, 2019.

(51) Int. Cl.

| | |
|---|---|
| ***G10D 3/16*** | (2020.01) |
| ***G10H 1/00*** | (2006.01) |
| ***F21V 33/00*** | (2006.01) |

(52) U.S. Cl.

CPC ..... *G10H 1/0083* (2013.01); *F21V 33/008* (2013.01); *G10D 3/16* (2013.01); *G10H 2220/191* (2013.01); *G10H 2220/201* (2013.01); *G10H 2220/365* (2013.01); *G10H 2220/395* (2013.01)

(58) Field of Classification Search

CPC ..... G10D 3/16; A63H 33/22; G10H 2220/021

See application file for complete search history.

(56) References Cited

U.S. PATENT DOCUMENTS

| | | | | |
|---|---|---|---|---|
| 8,506,107 | B2 * | 8/2013 | Zilber | H05B 47/115 315/307 |
| 10,102,835 | B1 | 10/2018 | Shah et al. | |
| 10,535,326 | B2 * | 1/2020 | Austad | G10D 3/16 |
| 2006/0213358 | A1 * | 9/2006 | Motsenbocker | G10H 3/185 84/731 |
| 2009/0308232 | A1 * | 12/2009 | McMillen | G10D 3/16 84/723 |
| 2015/0048749 | A1 * | 2/2015 | Braasch | H05B 45/10 315/193 |
| 2017/0257924 | A1 * | 9/2017 | Leung | F21V 23/00 |
| 2019/0392797 | A1 * | 12/2019 | Bossert | F21V 33/0056 |
| 2022/0014188 | A1 * | 1/2022 | Miyanaga | H01L 27/088 |
| 2022/0180845 | A1 * | 6/2022 | Martinez Orts | G10D 3/16 |

* cited by examiner

*Primary Examiner* — Daniel J Colilla

(57) ABSTRACT

A system is described for an enhanced bow piece of a stringed musical instrument. The enhancement includes a visual display element attached to the bow. The appearance of the display changes in response to bow motion, bow position, and one or more user-supplied inputs (e.g. buttons). The system can be entirely self-contained and used as a normal instrument bow, providing a light-up/responsive effect while the user plays their instrument in an otherwise normal way. There is some capability for multiple self-contained units to be locally synchronized, providing group-based visualizations. Alternatively, these devices can be monitored and controlled by an external control system.

3 Claims, 4 Drawing Sheets

| ID | Component ID Block |
|---|---|
| U1 | Adafruit Pro Trinket - 3V 12MHz |
| U2 | 6DOF MPU-6050 MPU6050 Module 3 Axis Gyroscope + Accelerometer Module |
| U3 | Adafruit Pro Trinket LiIon/LiPoly Backpack Add-On |
| U4 | WS2812B DC5V Individual Addressable RGB LED Strip Light |

MOTION/POSITION-SENSING RESPONSIVE LIGHT-UP MUSICAL INSTRUMENT

CROSS-REFERENCE TO RELATED APPLICATIONS

Provisional patent application No. 62/974,487 filed 4 Dec. 2019. See Application Data Sheet.

BACKGROUND OF THE INVENTION

The present invention relates to the field of musical instruments and visual displays. In particular, it relates to a bow for a violin, cello or other musical instrument, which is adorned with LEDs that light in various ways in response to the motion of the bow. More particularly, it relates to a combination of an accelerometer/gyro, microprocessor, battery, charging system and collection of LEDs, affixed to a bow and configured/programmed in ways that cause the LEDs to light in response to the use of the bow.

Musical instruments have been made and used for thousands of years. Violins have been made for hundreds of years, and by some counts, there may be millions of people who currently play violin. Usually the main aspect of a violin performance is the sound produced by the instrument. However, many performances are done live, in which case the audience is also visually observing the musician and their instrument. The visual element can be a significant part of the performance, with the performer wearing certain clothes, or with the stage decorated in a particular way so as to enhance the performance through these visual aspects.

There have been inventions to add visual element to the playing of musical instruments. Many bands incorporate light shows or laser shows as part of their shows. U.S. Pat. No. 7,501,571B2 describes an array of lights that responds to the sound of a musical instrument, which is fundamentally different from motion-based response.

U.S. Pat. No. 10,102,835B1 describes a server that communicates with drum sticks to generate responsive visual effects. The claims for that patent only cite applications to drum sticks. The description includes mention of violin bows, but few specifics are given. Moreover, the visualizations described in that patent are either externally displayed, presented through a virtual reality headset, or used in conjunction with wearable displays; whereas the present invention is focused on a display incorporated on the bow itself. This offers the advantage of creating visual effects that enhance the appearance of the bow itself: for example, a marquee effect in which lights appear to fall along the length of the bow based on its position; or an effect where the lights on the bow appear stationary while the bow is in motion; or an effect where the bow glows brighter and flashes more quickly as it is moved faster. The present invention is also focused on a self-contained system, which can be used as a normal bow, but can also present interesting visualizations, without the need for any external/additional components There are also violin bows available that include lights, some of which change color in a pre-defined pattern. While such a system may add interesting visual elements to a musical performance, the lighting of the bow is unrelated to the motion of the bow, and hence may appear detached from the music being heard. Lighting that changes in response to the music being heard is generally more interesting to an audience. This is one reason most stage shows include lighting managers.

Objects and Advantages

Accordingly, several objects and advantages of the present invention are:

a) to provide a light-up bow whose lighting pattern changes in response to the motion of the bow;

b) to provide a means for the musician to modify the type of pattern being displayed via a simple switch or a gesture;

c) to provide pre-defined programs where the detected motion causes various special effects to appear from the bow's lights;

d) to provide pre-defined programs to help improve bowing style, by detecting bow motion and providing visual feedback based on bow angle and other parameters;

e) to provide a built-in rechargeable battery and charging system so that the light-up bow can be used directly from the instrument's case, without the need to attach external wires and such;

f) to provide a visual display attached to a bow, so that the display may be enhanced by the motion or position of the bow, e.g. displaying a marquee-style pattern of falling lights, or the appearance of stationary lights on a moving bow;

g) to provide the ability to modify the programming of the bow's internal processor, to support the addition of new features and other upgrades; and h) to provide a system whereby the control unit and LEDs of a light-up bow can be easily removed from one bow and attached to another.

Further objects and advantages are to provide a system which is small, self-contained and thus unobtrusive to the playing of a musical instrument. Still further objects and advantages will become apparent from a consideration of the ensuing description and drawings.

SUMMARY

The present invention allows the addition of an emitted-light-based visual element to the playing of a musical instrument. The emitted light can be made to change in response to the motion of the bow, for example, displaying a bright starburst that begins in the middle of the bow and travels to both ends each time the bow changes direction. Since almost all music coming from a violin is generated in response to the motion of the bow, the visual effects also correspond to changes in the music being played. This can produce a pleasing or exciting visual display to enhance the music itself.

Description—First Embodiment

Figure 1:
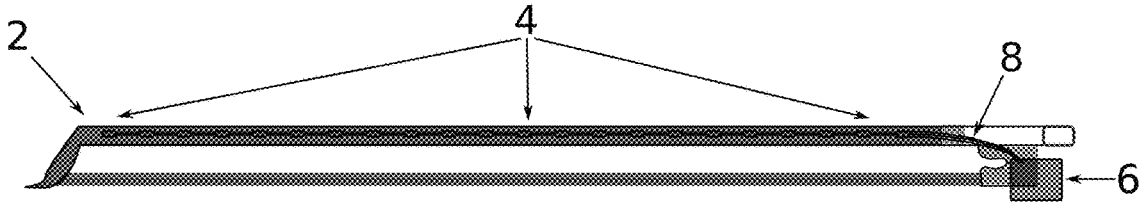
FIG. 1 illustrates the overall invention, with the control/sensing box attached to a bow.

FIG. 1 shows a particular embodiment of the present invention utilizing a violin bow 2 to which has been affixed a set of serially-connected light-emitting diodes (LEDs) 4 and a control/sensor box 6. A set of wires 8 are seen coming from the control/sensor box to the first LED.

The control box 6 contains a rechargeable battery, charging circuitry, a microprocessor, and an accelerometer/gyro for sensing motion and orientation of the box.

Figure 2:
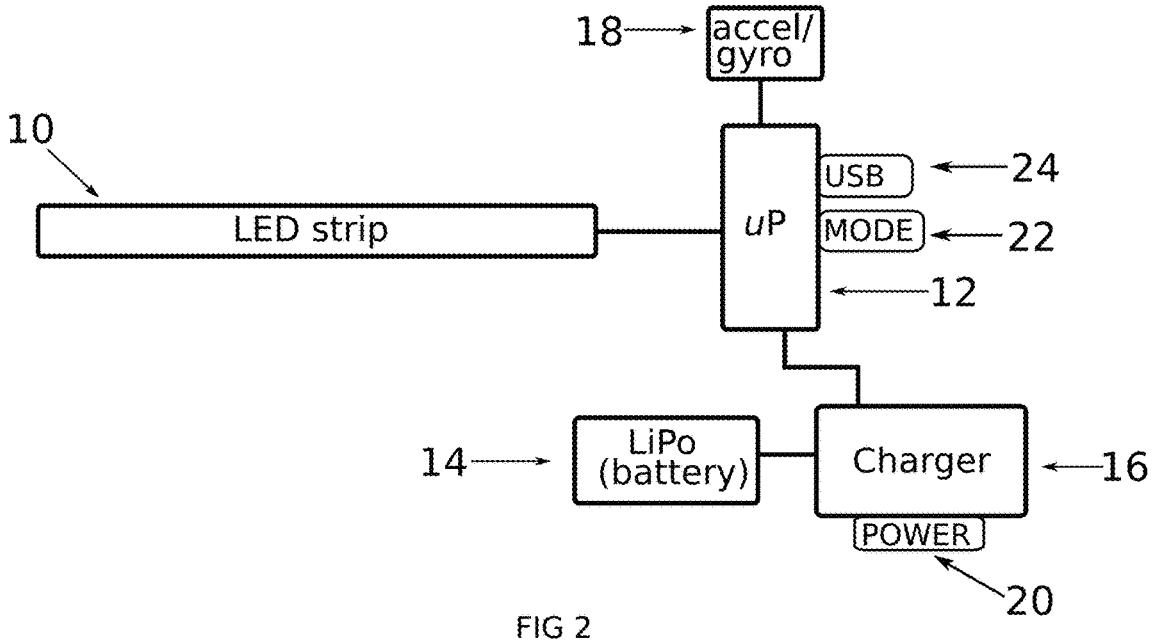
FIG. 2 illustrates a block diagram of the control/sensing circuit.

FIG. 2 shows a block diagram of the control/sensor box. LED string 10 is a set of individually-addressable 3-color LEDs, such as the NeoPixel WS2812. 12 is a microprocessor that supports SPI/I2C for serial communication, as well as digital I/O. A low-voltage (3.3) microprocessor board is especially appropriate, for use with a rechargeable lithium polymer battery 14, which can be recharged via a charging system 16. An accelerometer/gyro 18 is used to detect motion and/or orientation and convey this information to microprocessor 12. A pair of switches 20 and 22 are used to control the power to the entire system and to provide a mode input to the microprocessor, respectively. The mode switch is used by the microprocessor's program to indicate a change in the system's behavior, e.g. a change in the type of display being shown or the type of events to which the display reacts. USB port 24 is used both to program microprocessor 12 and to supply power to battery charger 16.

Figure 3:
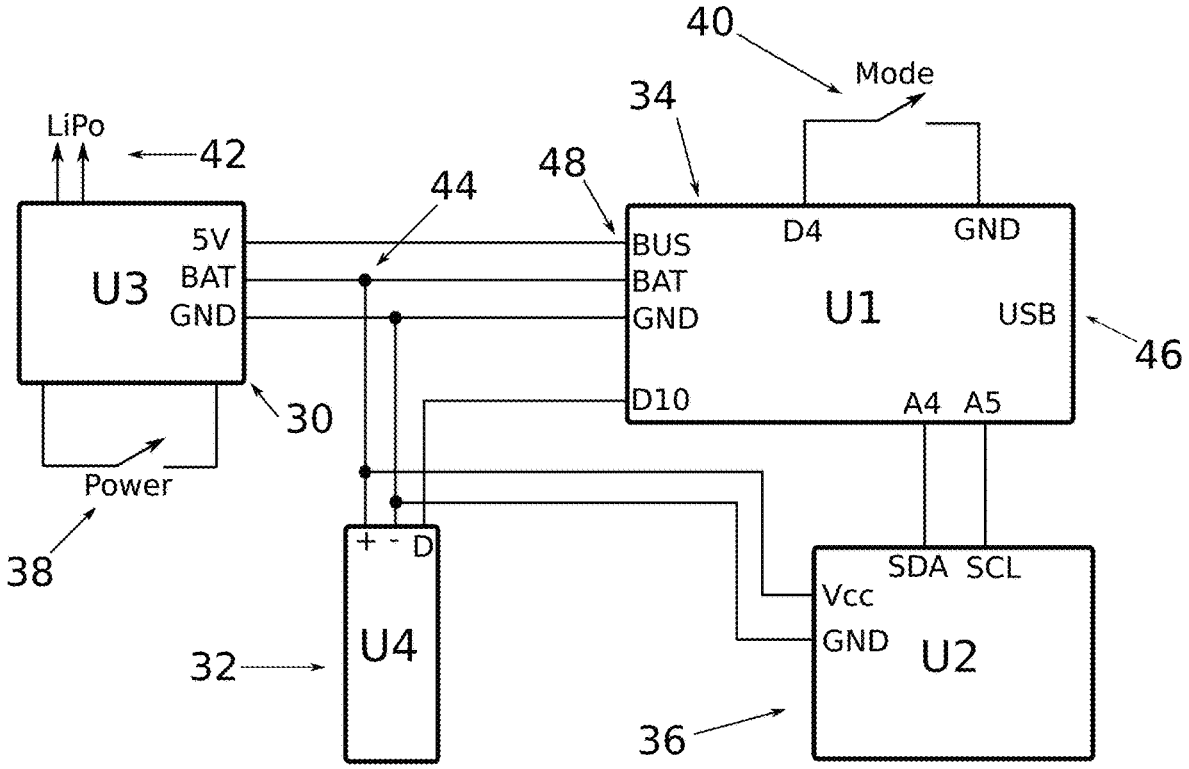
FIG. 3 illustrates a schematic diagram of the control/sensing circuit.

FIG. 3 shows a full schematic for a sample implementation of this system. This implementation is comprised of an Adafruit TinkerPro 3V processor 34; a 6500 6-axis gyro/accelerometer 36; a plurality of addressable LEDs such as a NeoPixel strip 32; an Adafruit Backpack Charger 30; a rechargeable LiPo battery 42; a mode switch 40; and a power switch 42. Sensor 36 must be attached to a violin bow, so that motion of the bow causes motion of the sensor. The plurality of LEDs 32 comprise an LED strip, which is also attached to the bow, so they can be seen by the player or the audience. In this embodiment, the circuitry, switches, and battery 42 are all attached to the bow, so the entire assembly is self-contained.

Figure 4:
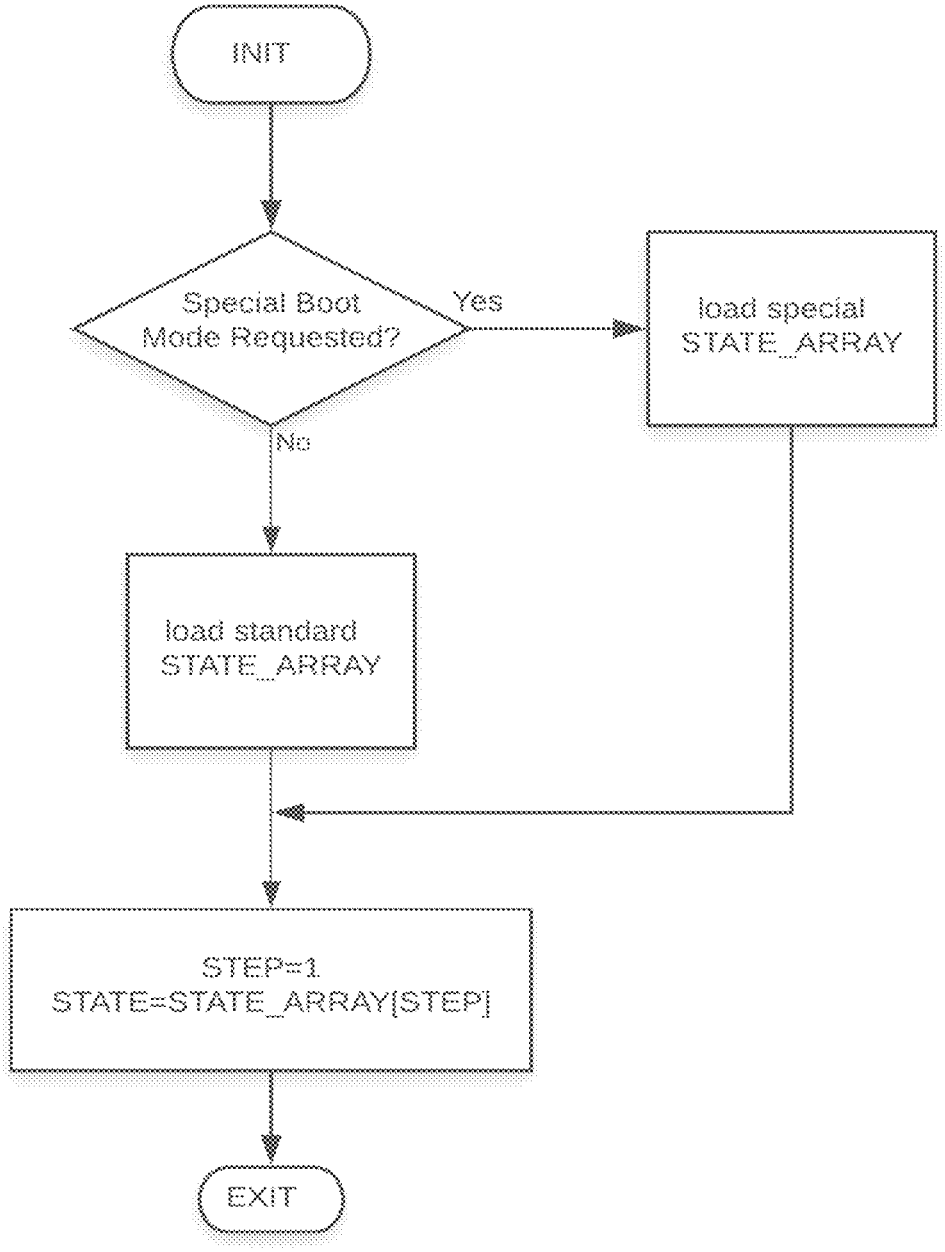
FIG. 4 illustrates a high-level flowchart for the control software initialization routine.

In the circuit configuration shown, processor 34 can read acceleration information from sensor 36. This sensor information is used to determine the motion of the bow, using algorithms such as shown in FIG. 4. Processor 34 then sends modulated signals to LED assembly 32 in order to activate lights in a desired way, as shown in the algorithm in FIG. 4.

Backpack 30 is connected to processor 34 and battery 42 such that it operates in one of the following ways:

- if switch 38 is open, battery 42 is effectively isolated from the BAT output 44, thereby turning the system off;
- if switch 38 is closed, battery 42 supplied power to BAT output 44, thereby powering processor 34, sensor 36 and LED strip 32.

Additionally, if USB port 46 on processor 34 is connected to a power source, then processor 34's BUS output 48 will drive Backpack 30, thus causing 30's circuitry to recharge battery 42.

FIG. 4 shows one algorithm for controlling the plurality of LEDs 32 in response to inputs from sensor 36 and mode switch 40. The algorithm is presented as a high level flowchart, whose detaila are described below. The particular implementation of this algorithm is irrelevant to the invention, and can be written in C, C++, assembly language, or any other language with basic conditional and looping capabilities. Most operations are performed with integers, and the few that use floats (for sin and cos) can be implemented with lookup tables if preferred.

A number of modes are described, as summarized here:

| MODE (STATE) | NAME | DESCRIPTION |
|---|---|---|
| 1 | Rainbow | This mode displays a rainbow-like pattern of colors that slowly change over time. |
| 2, 3 | Starburst | When the effect is triggered, a set of LEDs light near the middle of the bow. The LEDs split into two groups, which travel from the center to the ends of the bow, disappearing off the ends. The trigger can be based on bow direction (MODE 2), acceleration (MODE 3), or any other sensed change. The intensity, width etc. of the effect can be linked to magnitude of acceleration. The color of the LEDs can be randomized, based on acceleration, defined as different modes, etc. |
| 4 | Falling LEDs | LEDs blink in a marquee-type effect, giving the appearance of motion along the length of the bow. The direction of this apparent motion can be set based on bow direction, so the LEDs appear to fall down as the bow is tilted. Color, speed, etc. can be set in a variety of ways. |
| 5 | Bow Training | This mode can be used to, for example, help a player to draw the bow in a straight line, by giving visual feedback based on rotation or acceleration in a direction different from the intended bow movement, or how smoothly the bow moves, etc. |
| 6 | Flame | One of a number of modes for displaying particular effects, including a simulated flame effect (white at the bottom, orange higher up, yellow/red near the tip). The start/end of each region can be randomized and change over time, causing the appearance of a moving/dancing flame. |
| 7 | Time-Sync'd Color Change | Using a given gesture (e.g. hold the Mode Button for 5 seconds and then release), a timebase is recorded and used to control the display in this mode. By applying the gesture to multiple bows in unison, a common timebase is established, and all such bows will display the same pattern in this mode. |
| 8 | Blurb | A small set of LEDs is illuminated following the effect's trigger (e.g. sudden acceleration or change in bow direction), after which they quickly fade. The color, intensity and location of the LEDs can be randomized at each trigger event, or based on some factor of the trigger (e.g. intensity). The fade-schedule can be randomized, based on sensory data, etc. |

Figure 5:
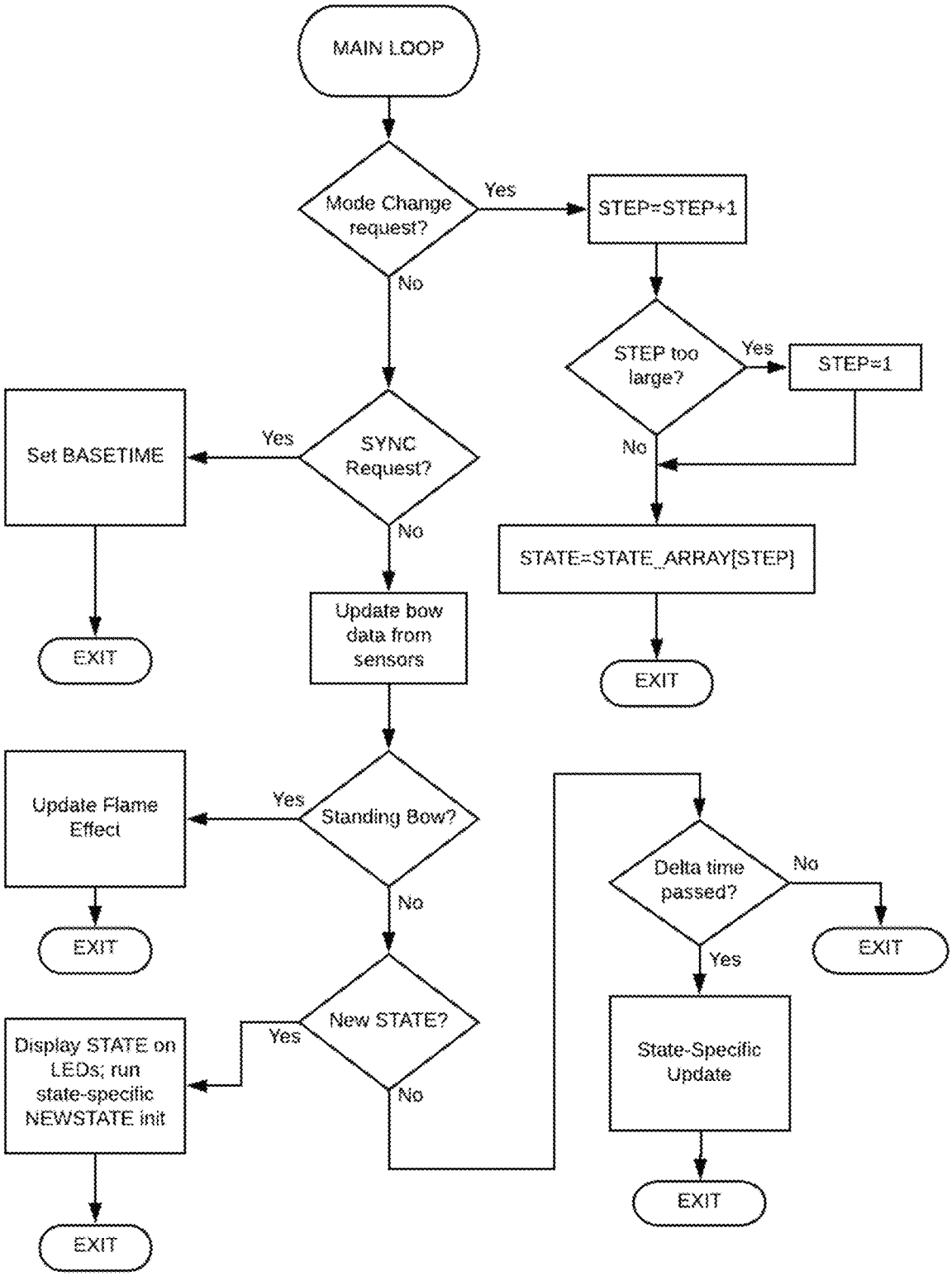
FIG. 5 illustrates a high-level flowchart for the control software main loop.

The algorithm in described in two pieces. FIG. 4 shows a short initialization section ("INIT") while FIG. 5 shows a main loop ("MAIN LOOP") that should be executed repeatedly for as long as the device is powered. FIGS. 4 and 5 are only high-level views of the software; detailed descriptions are described presently.

Init

This set of code is executed once, on device power-up. It involves initializing the LED output assembly, as well as the accelerometer/gyro sensors. Additionally, an array of predefined steps is loaded into STATE_ARRAY, indicating the order in which the mode button should cycle through the different modes. This can be used to customize the behavior of the bow for a particular performance. For example, given the arrangement of music being planned for a given show, there may be a certain sequence of modes through which the bow should cycle each time the mode button is pressed. STEP is set to 1 and STATE is then set to STATE_ARRAY [STEP].

As an additional feature, if the Mode Button is held in a pressed state during the INIT phase, an alternate sequence can be pre-loaded into this STATE_ARRAY. A typical alternate sequence would be one which simply cycles consecutively through each possible mode. Thus, the bow can be used with a performance-defined sequence (by simply powering the bow), or can be powered-up with the mode button held, thus allowing the bow to be used in any possible modes.

Main Loop

The main loop is called repeatedly, and has four main sections:

1. Check the Mode Button, and if it is pressed:
   increment STEP and rollover if greater than MAX_STEP
   set STATE to STATE_ARRAY[STEP];
   display STEP on the LED display (by lighting the corresponding number of LEDs);
   wait for the Mode Button to be released;
   If Mode Button is pressed for more than 5 seconds, flash LEDs and set SYNCFLAG. When button is released (with SYNCFLAG set):
   Set BASETIME=TIMESTAMP
   wait for a brief debounce time;
   record TS=current TIMESTAMP (time since power-on); and
   set the NEWSTATE flag, indicating the system has just entered a new state.
2. Update bow data based on sensor readings:
   if z acceleration is close to accereration due to gravity, set the STANDING_BOW flag;
   if acceleration along the length of the bow exceeds a given threshold, set the BOW_SHOCK flag;
   detect the tilt of the bow and set the UPBOW flag accordingly.
3. If DO_STANDING_BOW is enabled and the STANDING_BOW flag has been set, display/update the flame pattern and exit the loop;
4. Otherwise, take an action based on the current value of STATE, as described below:

STATE=1 ("Rainbow Effect") there is a specific "delta" for this effect. This mode displays a rainbow-like pattern of colors that slowly change over time.

```
if NEWSTATE:
load initial rainbow pattern into LEDs. For example, set
    LED (i) as follows:
    red=8*(1+cos(i/10))
    green=8*(1+sin(i/10))
    blue=8*(1+sin(i/5))
set OFFSET=0
clear NEWSTATE
exit loop
else if TIMESTAMP-TS<delta, exit loop
else:
increment OFFSET
set LED(i) as follows:
    red=8*(1+cos((i+offset)/10))
    green=8*(1+sin((i+offset)/10))
    blue=8*(1+sin((i+offset)/5))
set TS=TIMESTAMP
exit loop
```

STATE=2 ("Starburst") there is a specific "delta," "width" and "color" for this effect. Note that color could change each time BOW_DIRECTION changes, each time NEWSTATE is set, etc. and could cycle in a predefined way, or be randomized, or based on any desired parameter.

```
if NEWSTATE:
clear all LEDs
clear NEWSTATE
record BOW_DIRECTION (from UPBOW flag)
set START=0
exit loop
else if TIMESTAMP-TS<delta, exit loop
else:
set TS=TIMESTAMP
if BOW_DIRECTION!=UPBOW, set START=0
BOW_DIRECTION=UPBOW
light LEDs (given color) from CENTER+START to
    CENTER+(START+WIDTH)
light LEDs (given color) from CENTER-START to CEN-
    TER-(START+WIDTH)
clear other LEDs
increment START
if CENTER+START >total # of LEDs, set START=total
    # of LEDs (effect off)
exit loop
```

STATE=3 (acceleration-based starburst) is the same as STATE=2, but instead of responding to a change in UPBOW, respond when the magnitude of the acceleration in the direction of bow movement exceeds some threshold STATE=4 ("Falling LEDs") there is a specific "delta" "width" and "color" for this effect. Again, color can be adjusted as desired. This is a marquee effect, where the LEDs seem to move in one direction or another, based on acceleration along the length of the bow.

```
if NEWSTATE:
clear all LEDs
clear NEWSTATE
set START=0
exit loop
else if TIMESTAMP-TS<delta, exit loop
else:
START=(START+/−1) % width (increment or decrement
    based on acceleration sign)
light each LED whose position=START (mod width)
set TS=TIMESTAMP
exit loop
```

STATE=5 ("Bow Training") there is a specific "threshold" for this effect. This is a simple mode for helping a player to bow in a straight line. Deviations from a straight line cause LEDs to be lit.

If acceleration towards/away from player>threshold. Light LEDs, else clear LEDs. The intensity, color, number of LEDs, etc. can be adjusted based on the magnitude of the acceleration, for example.
exit loop STATE=6 ("Flame") there is a specific "delta" for this effect. This is a randomized flame effect.

if NEWSTATE:
set TS=TIMESTAMP
clear NEWSTATE
exit loop
else if TIMESTAMP-TS<delta, exit loop
else:
set TS=TIMESTAMP
set LEDs based on position: moving away from the frog, LEDs are, for example, white, then orange, then red. The location of each region is randomized, causing an effect where the flame appears to dance.
exit loop STATE=7 ("Time sync'd color change") This is a mode where, if multiple bows have previously been time-synchronized (by holding the Mode Button for at least 5 seconds, and then releasing in unison), the LEDs will display a pattern that is synchronized across multiple bows.

if NEWSTATE:
clear all LEDs
clear NEWSTATE
exit loop
else:
display pattern based on (TIMESTAMP-BASETIME). Note that BASETIME is initialized in response to holding the mode button pressed and then releasing it. This allows multiple bows to synchronize their BASETIME.
exit loop STATE=8 ("blurb") there is a specific "width" and "delta" for this effect. A random set of LEDs is illuminated following the effect's trigger (e.g. BOW_SHOCK), after which they quickly fade.

if BOW_SHOCK:
set TS=TIMESTAMP
set red, green, blue to random values
set start to random value
clear all LEDs
set LEDs from start to start+width to given (red, green, blue) color
exit loop
else if TIMESTAMP-TS<delta
set intensity of lit LEDs based on (TIMESTAMP-TS)
exit loop
else:
clear all LEDs
exit loop

Operation—First Embodiment

The bow is turned on with the power switch, which causes the microprocessor to boot and begin executing its internal code. As can be seen from the above pseudocode, the processor will run through an initialization stage, set STATE to the first element of STATE_ARRAY, and will then begin repeatedly executing its main loop. This startup typically takes a few seconds.

Once the initialization is done, the bow can be used as a regular stringed-instrument bow to make music, but the LEDs may be illuminated and responsive to the motion or position of the bow, as described in the table of modes above.

To change modes, the Mode Button is pressed and released. Doing so causes a number of LEDs to be illuminated for a few seconds: the number of illuminated LEDs indicates the step which will be entered next. For example, after power-up, the system is in step 1 (which corresponds to STATE_ARRAY[0]). After pressing the Mode Button once, two LEDs will briefly be illuminated indicating that the bow is changing to step 2 (STATE_ARRAY[1]). Pressing the Mode Button again will cause three LEDs to be briefly illuminated, indicating a transition to step 3; and so on. After the final step, pressing the Mode Button again illuminates a single LED, indicating a return to step 1.

Pressing and releasing the Mode Button is the only action required by the user, other than using the bow in the usual fashion.

If the user wishes to synchronize multiple bows, the Mode Button can be held for at least 5 seconds on each of a set of bows, after which all LEDs will flash, indicating the bow is ready to be synchronized. Releasing the button marks a timebase inside the bow, thus by releasing the Mode Button simultaneously on multiple bow, they will share a common time base. After this, switching to the Time-Sync'd mode will cause all bows to display LED patterns that move in unison with each other.

An optional state is available by holding down the Mode Button while power is being turned on. After several seconds (when the boot sequence is completed) the Mode Button is released, after which the bow will function as usual, except that the Mode Button will now move through an alternate sequence of states. This alternate sequence is typically set to a sequence containing every possible state, thus allowing the user to cycle through all possible states.

Description and Operation—Second Embodiment

In a second preferred embodiment of this invention, each controller operates as described above, but with an additional step inside the Main Loop. In this extra step, a serial communication line is checked for incomming messages, and if present, that message is processed.

The serial communication line use a simple receive-only RS-232 protocol. The sender of these messages can be a centralized transmitter, capable of sending a message to each controller. The message can contain coded information, such as "ID:MODE" where ID is a 3 digit BOW ID and MODE is a 2-digit MODE. Each system receives this message, and compares the ID to its own internal (permanent) ID. If these IDs match, it takes the second part of the message (NODE) and loads that into its STATE variable. In this way, the STATE of any bow can be controlled from an external location by broadcasting an ID:MODE message to all bows.

Alternatively, serial communication could use an addressable protocol such as 802.11, Bluetooth, I2C or SPI. Messages could then be sent to each bow by using the address of that bow's receiver.

In either case, a light board or other central controller can thus set the state of each bow, thereby allowing centralized control of bow states during a performance. Each bow still retains the functionality of its Mode Button, allowing for local mode control.

SUMMARY, RAMIFICATIONS, AND SCOPE

From the above descriptions, it can be seen that the motion/position-sensing responsive light-up musical instrument described herein is a versatile device, with a high degree of flexibility in its specific coding, offering the user a wide range of operational modes, easily selectable via the Mode Button. The built-in sensor can detect acceleration, allowing the code to infer bow motion, changes in speed, and direction relative to gravity. It can also sense rotation, allowing the code to detect deviations from straight-line motion of the bow. The collection of LEDs allows a variety of visual effects, including simulated motion and colorful displays, which can be automatically choreographed to the music being played, creating an exciting and pleasing multimedia presentation.

While the above descriptions contain many specificities, these should not be construed as limitations on the scope of the invention, but rather as exemplifications of two preferred embodiments thereof. Other variations are possible, including changes mentioned in the description of the system's pseudocode. Accordingly, the scope of the invention should be determined not by the embodiments illustrated, but by the appended claims and their legal equivalents.

What is claimed is:

1. A visual effects system for a bow of a stringed musical instrument, said system comprised of: a plurality of individually-addressable LEDs attached to or embedded in said bow; a means for a user of said bow to provide instructions to said system; a motion- or orientation-sensing device attached to said bow; and a microprocessor, where said microprocessor is configured to control illumination of said LEDs so as to present a marquee effect of lights in motion, said motion's direction and appearance being dependent on detected angle of said bow and on said instructions.

2. A visual effects system for a bow of a stringed musical instrument, said system comprised of: a plurality of individually-addressable LEDs attached to or embedded in said bow; a means for a user of said bow to provide instructions to said system; a motion- or orientation-sensing device attached to said bow; and a microprocessor, where said microprocessor is configured to detect acceleration along the bow's length in excess of a threshold and, in response to said detection and according to said instructions, control illumination of said LEDs so as to illuminate a randomly-located set of adjacent LEDs and, after a period of time, turn off said LEDs.

3. A visual effects system for a bow of a stringed musical instrument, said system comprised of: a plurality of individually-addressable LEDs attached to or embedded in said bow; a means for a user of said bow to provide instructions to said system; a motion- or orientation-sensing device attached to said bow; and a microprocessor, where said microprocessor is configured to detect a change in direction of said bow and, in response to said change and according to said instructions, control illumination of said LEDs so as to illuminate two sets of adjacent LEDs near the middle of said bow, and subsequently begin a pattern of waiting a period of time, turning off said sets of adjacent LEDs, and then illuminating two new sets of adjacent LEDs further from said middle, thereby giving a visual effect of two sets of adjacent LEDs moving from said middle to each end of said bow.

* * * * *